US009481551B2

(12) United States Patent
Krampl et al.

(10) Patent No.: US 9,481,551 B2
(45) Date of Patent: Nov. 1, 2016

(54) ESCALATOR OR MOVING WALKWAY WITH A TRANSPARENT BALUSTRADE

(71) Applicant: Inventio AG, Hergiswil (CH)

(72) Inventors: David Krampl, Vienna (AT); Günther Niedermayer, Vienna (AT); Michael Matheisl, Vösendorf (AT); Gerhard Kleewein, Pressbaum (AT)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 14/652,476

(22) PCT Filed: Dec. 3, 2013

(86) PCT No.: PCT/EP2013/075304
§ 371 (c)(1),
(2) Date: Jun. 16, 2015

(87) PCT Pub. No.: WO2014/095331
PCT Pub. Date: Jun. 26, 2014

(65) Prior Publication Data

US 2015/0329328 A1 Nov. 19, 2015

(30) Foreign Application Priority Data

Dec. 18, 2012 (EP) ..... 12197721

(51) Int. Cl.

| | |
|---|---|
| ***B66B 23/24*** | (2006.01) |
| ***B66B 23/22*** | (2006.01) |
| ***B66B 21/10*** | (2006.01) |
| ***B66B 21/02*** | (2006.01) |
| *B66B 19/00* | (2006.01) |

(52) U.S. Cl.
CPC ..... *B66B 23/22* (2013.01); *B66B 21/02* (2013.01); *B66B 21/10* (2013.01); *B66B 19/007* (2013.01); *Y10T 29/49718* (2015.01)

(58) Field of Classification Search
CPC ..... B66B 23/00–23/26; B66B 21/00–21/12; B66B 25/00–25/006; B66B 27/00; B66B 29/00–29/08; B66B 31/00–31/02
USPC ..... 198/335–338; 52/182, 183, 208, 238.1; 256/24–31
See application file for complete search history.

(56) References Cited

U.S. PATENT DOCUMENTS

| | | | | |
|---|---|---|---|---|
| 2,686,585 A * | 8/1954 | Margles | B66B 21/04 198/332 |
| RE25,531 E * | 3/1964 | Fabula | B66B 23/04 198/331 |

(Continued)

FOREIGN PATENT DOCUMENTS

| | | |
|---|---|---|
| JP | H04 201980 A | 7/1992 |
| JP | 2007 062867 A | 3/2007 |
| JP | 2011 173711 A | 9/2011 |

*Primary Examiner* — William R Harp
(74) *Attorney, Agent, or Firm* — Ladas & Parry LLP

(57) ABSTRACT

The invention relates to a transparent balustrade (12) of an escalator (1) or of a moving walk, comprising a balustrade skirt (13), at least one glass panel (33), and a handrail guide (15) with a handrail (14). The at-least one glass panel (33) has an upper edge (9) and a lower end (6) and, at its lower end (6), is gripped in a mounting (18) in the balustrade skirt (13) in locationally fixed manner. The transparent balustrade (12) contains at least one support (20), which is tightly joined to the balustrade skirt (13). The glass panel (33) is deformable perpendicular to its planar extent and therefore in lateral direction. Through its elastic deformability, to absorb lateral forces (F) the glass panel (33) displays lateral displaceability within a permissible deformation play (s), lateral displaceability within the permissible deformation play (s) being limited by the support (20).

16 Claims, 3 Drawing Sheets

(56) References Cited
U.S. PATENT DOCUMENTS 4,488,631 A * 12/1984 Courson ..... B66B 23/22
198/335

4,841,697 A * 6/1989 Hogg ..... E04F 11/1851
198/335

* cited by examiner

ESCALATOR OR MOVING WALKWAY WITH A TRANSPARENT BALUSTRADE

The present invention relates to a transparent balustrade of an escalator or moving walk and to an escalator or moving walk with a transparent balustrade.

Various balustrades for escalators and moving walks are known from the prior art. In EP 0 913 354 B1, a balustrade for an escalator or moving walk is disclosed which, because of its massive, rigid structure, is designed for so-called heavy-duty use in train stations, airports, and subway stations.

DE 298 15 363 U1 discloses a balustrade for a passenger transportation system wherein the glass panels that are used for the transparent balustrade consist of at least two safety glasses with adhesive film in between them. Through their transparency, such transparent balustrades give the escalator or moving walk an elegant, filigree, and lightweight appearance. A transparent balustrade of the said type is often referred to as a glass balustrade.

In JP 2011 173711 A, a transparent balustrade is disclosed, which comprises a balustrade skirt, at least one glass panel, and a handrail guide with a handrail. The glass panel has an upper edge and a lower end that is opposite to the upper edge. At its lower end, the glass panel is held in locationally fixed manner in a mounting in the balustrade skirt. The transparent balustrade contains at least one support, which is joined in locationally fixed manner to the balustrade skirt. In addition, elastic properties of the glass panel are used to absorb impact energy by a limited elastic displacement of the upper edge of the glass panel through deformation of the glass panel perpendicular to the plane of its surface and therefore in lateral direction. To prevent fracturing of the glass panel, the lateral displacement of the upper edge is limited by means of a stop. This stop is embodied between the support and the upper edge of the glass panel.

Although in JP 2011 173711 A, in order to prevent fracture of the glass the displacement of the glass panel is limited, such transparent balustrades can only be used to a limited extent in public facilities with large passenger flows, such as, for example, train stations, airports, or subway stations. The support is only effective when the forces, or impacts, act directly on the handrail, as shown in FIG. 2 of JP 2011 173711 A. If a shock acts on the glass panel below the handrail, the glass panel may bend excessively in the middle and break nonetheless.

Transparent balustrades of the said type are therefore typically used in department stores and not for heavy-duty use in train stations, airports, or subway stations. In the regulations for escalators or moving walks in heavy-duty use (European Standard EN115, country-specific underground train standards, load specifications, operator specifications), a lateral load on a balustrade of 200 to 300 kg per meter of transportation length is defined, whose action on the balustrade may result from the transportation of heavy baggage or a vandalous attack on a balustrade, which must be absorbed by the balustrade without damage. For the relevant standards to be fulfilled, the transparent balustrades are embodied correspondingly thick, which is substantially reflected in the overall weight of the escalator or moving walk and in the cost of its manufacture.

The objective of the invention is to overcome the disadvantages of the prior art. In particular, a transparent balustrade for heavy-duty use shall be made available which fulfils the relevant regulations and whose manufacture is inexpensive.

This objective is fulfilled by a transparent balustrade of an escalator or moving walk. The transparent balustrade comprises a balustrade skirt, at least one glass panel, and a handrail guide with a handrail. The glass panel has an upper edge and a lower end that is opposite to the upper edge. At its lower end, the glass panel is held in locationally fixed manner in a mounting in the balustrade skirt. The transparent balustrade contains at least one support, which is joined in locationally fixed manner to the balustrade skirt. In addition, elastic properties of the glass panel are used to absorb impact energy through:

- a limited elastic displacement of a part of the glass panel, through deformation of the glass panel perpendicular to the plane of its surface and therefore in lateral direction, being permitted;
- the lateral displacement within a permissible deformation range that depends on the material properties of the glass panel taking place in order to prevent a fracture of the glass panel; and
- the lateral displaceability within the permissible deformation play being limited by the support.

To limit the lateral displaceability, the support has a contact-edge, which faces the glass panel. In the unloaded state, the deformation play is arranged between the contact-edge of the support and the glass panel. Upon total displacement, i.e. when the balustrade or glass panel is displaced until it strikes against the support, the contact-edge of the support touches the glass panel. Further displacement is thereby prevented and the excessive forces are resisted by the support in the truss.

The glass panel is essentially a glass plate or glass pane which has no frame, for example a massive, rigid metal frame. However, for the purpose of protection, the glass panel can have a very flexible frame, which is made of, for example, plastic or thin metal, and which, when the glass is bent, does not cause any stress peaks in the edge-zone of the glass panel.

A "deformation play" is to be understood as that displacement distance by which the glass panel can be displaced laterally, in other words, perpendicular to a longitudinal direction of the balustrade or to a transportation direction of the escalator or moving walk. Normally, the maximum displacement, with maximum displacement distance, occurs at only one point of the glass panel, for example at mid-height or at its upper edge. If the glass panel or balustrade is loaded with suddenly occurring lateral forces, for example by a baggage article falling from a baggage cart, the glass panel can yield laterally by the distance of the deformation play and, as a result of these lateral forces, absorb at least part of the impact energy. Through the lateral yielding of the glass panel, the lateral impact is damped and the impact energy is reduced. Through being limited by the predefined deformation play, the load that exceeds a permissible material value of the glass-panel material, or the acting force or lateral force, can be supported on the support without the glass panel fracturing. If the glass panel crashes against the support, the impact energy is so far reduced that the remaining impact does not cause any damage to the glass panel. The permissible material value may be, for example, the tensile strength or bending strength of the glass. The glass panel may comprise, for example, a safety glass or, preferably, a laminated safety glass.

The upper edge may be freely displaceable within the deformation play. Care must, however, be taken that, in the area of the mounting, no stress peaks can occur. Preferably, to limit the displacement, the support has a contour, which, by means of a radius, avoids stress peaks in the area of the mounting.

The deformation play can be free, in other words, the glass panel is essentially freestanding and is not guided in its displacement. In the unloaded state, the glass panel has no contact to a limiting element that specifies the deformation. However, it is also conceivable that the deformation play is filled with an elastic mass, for example a silicon, natural rubber, or rubber-like body, which may have additional damping properties.

The support is preferably directly connected to the supporting frame of the escalator or moving walk. Depending on the embodiment of the support, such a support depends on an absolute limitation of the lateral displacement. With suitable embodiment, damage to the glass panel, and corresponding damage to the balustrade, can be prevented, since excessive forces are directly or indirectly transmitted through the support to the supporting frame. With known means, for example with fastening brackets, such a support can be connected to the supporting frame and/or to the balustrade skirt.

At least in a partial area, the contact-edge of the support may have a damping layer. Such a damping layer prevents a hard impact of the glass panel on the support. A damping layer is particularly recommendable if the glass panel is made of glass and the support is made of metal, for example of steel. The danger of damage to the glass panel is then reduced even further.

The damping layer can be a fibrous material such as wood or felt, but preferably a more weather-resistant material from the material group of polymer materials, especially elastomers as, for example, silicone rubber, foamed polyurethane, synthetic rubber, or copolymer styrol.

The deformation play can be between 2 mm and 10 mm, preferably between 4 mm and 8 mm, and especially preferably between 5 mm and 6 mm. A deformation in the said range has shown itself to exert only a non-dangerous load on a glass panel and the glass panel to be correspondingly undamaged. Needless to say, these values apply for normal heights of the balustrade, in other words, for balustrade heights between 90 cm and 110 cm.

The glass panel may be of safety glass or single-sheet safety glass, preferably of laminated safety glass or double-sheet safety glass. The glass panel can be mounted with its upper edge in a longitudinal section. This mounting need not necessarily be fixed, movable mountings are also conceivable. Through the use of a longitudinal section, for example the handrail guide with circulating handrail can be easily mounted.

The longitudinal section can be joined to the support. Particularly if the handrail guide and handrail are arranged on the longitudinal section, support of the longitudinal section on the support is expedient, since then, the forces, or lateral forces, are transmitted from the handrail, not into the glass panel, but into the supporting frame and/or into the balustrade skirt. It is also possible for a plurality of supports to be arranged over the length of the escalator or moving walk.

The upper edge of the balustrade can be accommodated in an elastic flexible bearing of the longitudinal section. Although such an elastic bearing allows locationally fixed accommodation of the glass panel, such a bearing also allows swiveling of the upper edge of the glass panel when this, for example, is pressed in a middle area and correspondingly displaced.

The contact-edge of the support can define a minimum bending radius for the glass panel. For example, the contact-edge is embodied convex. The glass panel can thus, in its lower area, rest on the contact-edge, so that only through the convex curvature of the contact-edge does a deformation play in the upper range occur. Alternatively, the contact-edge can have a concave curvature. In this case, it is conceivable that the glass panel rests on the contact-edge by its upper and lower area. A deformation play is then present in a central area and displacement is correspondingly only possible there. The curvature of the convex or concave contact-edges can match the minimum permissible bending radius of the glass panel and, depending on the glass panel that is used, can be correspondingly adapted. This bending radius can be between 12 m and 490 m, in particular between 24 m and 280 m, preferably between 32 m and 120 m.

It is also conceivable that the contact-edge is a straight line and, along its entire length, has the same distance to the glass panel in its unloaded position or has a continuously linearly increasing distance to the glass panel. With a straight embodiment of the contact-edge it should be noted that the minimum bending radius is locationally dependent. Combinations of the said forms are also conceivable.

The handrail guide can be fastened to the support. The fastening can be direct or via the longitudinal profile. A correspondingly supported handrail guide transfers the forces from the handrail, not into the glass panel, but into the supporting frame or into the balustrade skirt. It is also possible for a plurality of supports to be arranged over the length of the escalator or moving walk.

An escalator or moving walk has a balustrade as described above. The already stated advantages correspondingly apply. In particular, such an escalator or moving walk can be used in the heavy-duty area in a public space.

A supporting frame or truss of the escalator or moving walk can have, in particular arranged at regular intervals, a plurality of acceptance points for fastening supports of the balustrade. Hence, according to need and depending on the lateral forces that must be absorbed, or on the mechanical properties of the glass panel, more or fewer supports with a larger or smaller support interval can be arranged. The distance from the acceptance points is, for example, between 30 cm and 50 cm. This allows different support distances to be realized, a modular structure is possible. Exemplary support distances are 30 cm, 40 cm, 50 cm, 60 cm, 80 cm, 100 cm, 120 cm, 150 cm, 160 cm, etc. Furthermore, through the material thickness of the supports, the supporting width or contact width of the glass per support can be given. This support width can be between 0.5 mm and 60 mm, preferably between 5 mm and 25 mm, particularly preferably between 12 mm and 18 mm.

Self-evidently, also an existing escalator or an existing moving walk can be retrofitted with the transparent balustrades described above. This modernization process of an existing escalator, or of an existing moving walk, contains the steps, that at least one of the present balustrades of an existing moving walk, or of an existing escalator, is removed, and, that the existing escalator or the existing moving walk is provided with at least one transparent balustrade according to the invention.

BRIEF DESCRIPTION OF THE DRAWINGS

By reference to figures, which only represent exemplary embodiments, the invention is explained in greater detail below. Shown are in FIG. 1 a simplified view of an escalator.

DETAILED DESCRIPTION OF THE INVENTION

Figure 1:
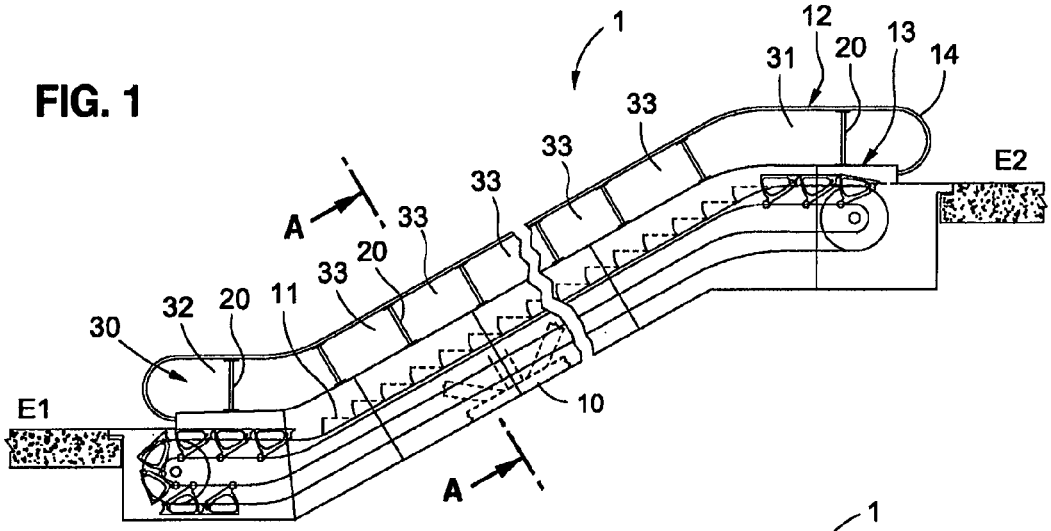

FIG. 1 shows a simplified view of an escalator 1 with a supporting frame 10, or truss 10. The escalator 1 connects a lower level E1 with an upper level E2 of a building. Arranged in the supporting frame 10 is a circulating step-band 11, which, in the upper level E2 and in the lower level E1 is reversed, and therefore has a forward-running section and a backward-running section. For greater clarity, the backward-running section is not shown, nor the bracket plates, guiderails, rail blocks, or a drive unit. The escalator 1 further has two balustrades 12, which extend along each long side of the step-band 11, in FIG. 1 only the balustrade 12 that is situated at the front in the viewing plane being visible. Arranged in circulating manner on each balustrade 12 is a handrail 14, its backward-running section being arranged in a balustrade skirt 13, which connects the balustrade 12 with the supporting frame 10. The balustrade 12 has a plurality of transparent glass panels 31, 32, 33, an upper glass panel 31 and a lower glass panel 32 having special forms. The central glass panels 33 are essentially rectangular plates. In addition to the glass panels 31, 32, 33, arranged on the outside of the balustrade 12 in the running direction of the escalator 1 is a plurality of supports 20 (see also FIG. 2).

Figure 2:
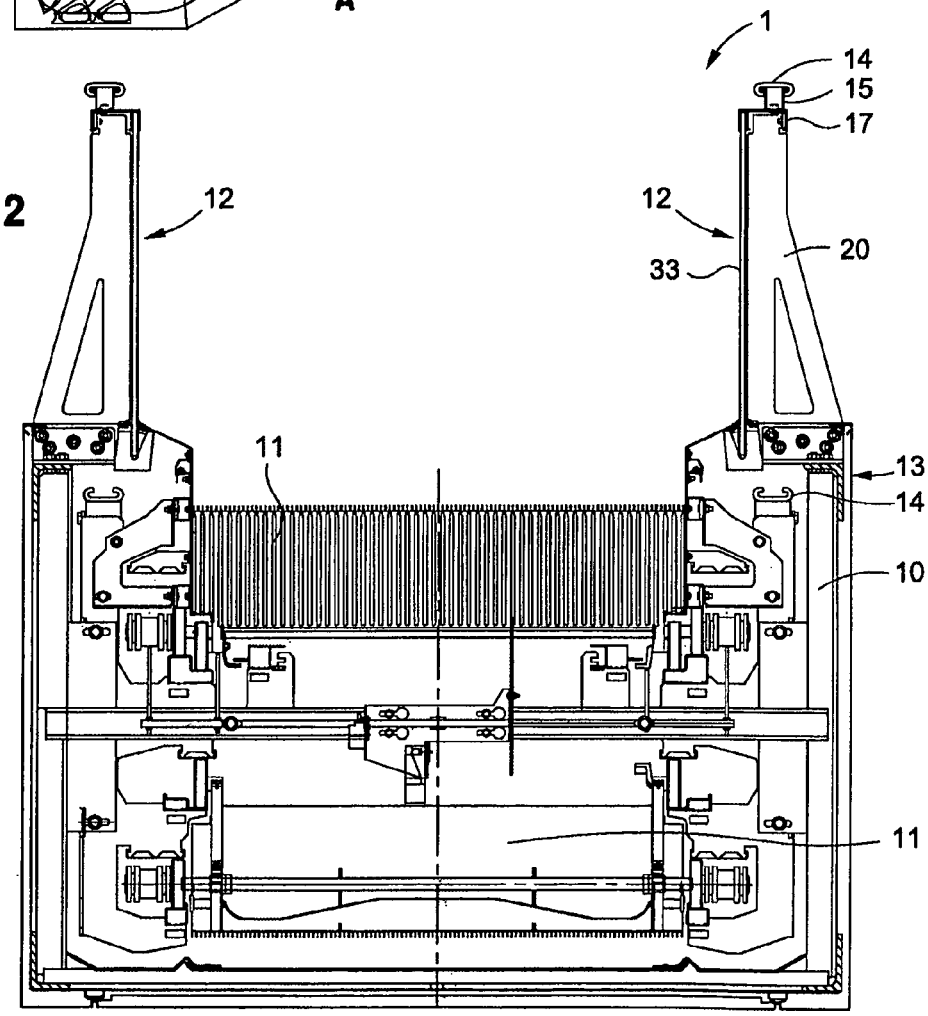
FIG. 2 a cross section through the escalator according to FIG. 1 along the line A-A.

Shown in FIG. 2 is a cross section through the escalator 1 according to FIG. 1 along the line A-A. Visible in this cross section are both the forward-running and the backward-running section of the step-band 11. The step-band 11 is guided on guiderails inside the supporting frame 10. Arranged to the left and right of the forward-running, when used as intended, upper, section of the step-band 11 is, in each case, a balustrade 12 and a balustrade skirt 13, the balustrade skirt 13 serving to accommodate the individual glass panels 33. Also guided in the balustrade skirt is the backward-running section of the handrail 14. At its lower end, the glass panel 33 is gripped in the balustrade skirt 13 in locationally fixed manner. The upper end of the glass panel 33 is accommodated by a longitudinal section 17, which is fastened onto the support 20 and at the same time accommodates the handrail guide 15 with the handrail 14. Inside the balustrade skirt 13, the support 20 is bolted to the supporting frame 10 in locationally fixed manner.

Figure 3A:
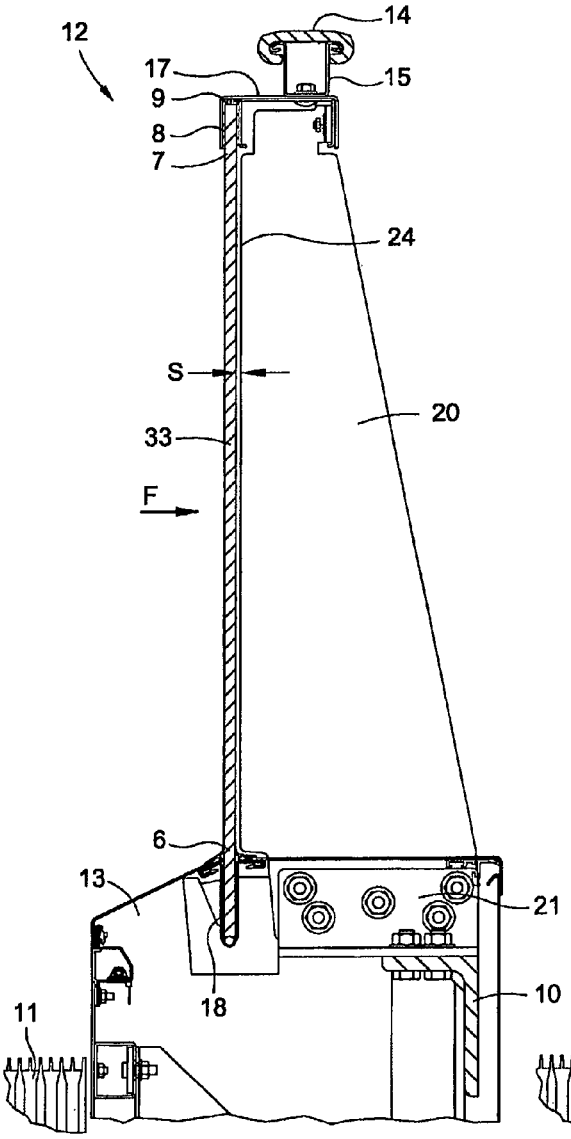
FIG. 3*a* a cross section through a balustrade in a first embodiment.
Figure 3C:
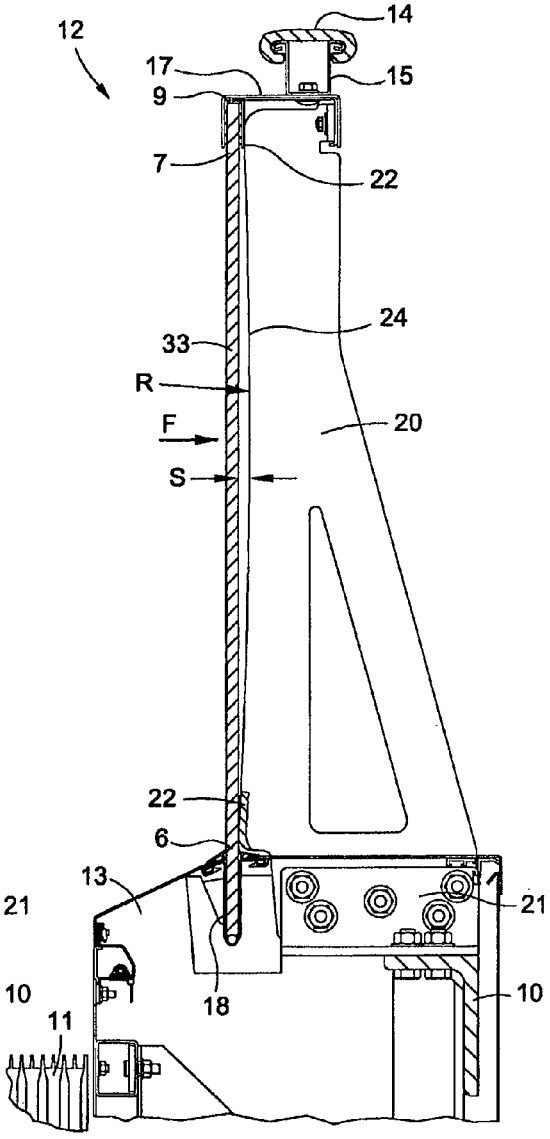
FIG. 3*c* a cross section through a balustrade in a further embodiment.
Figure 3B:
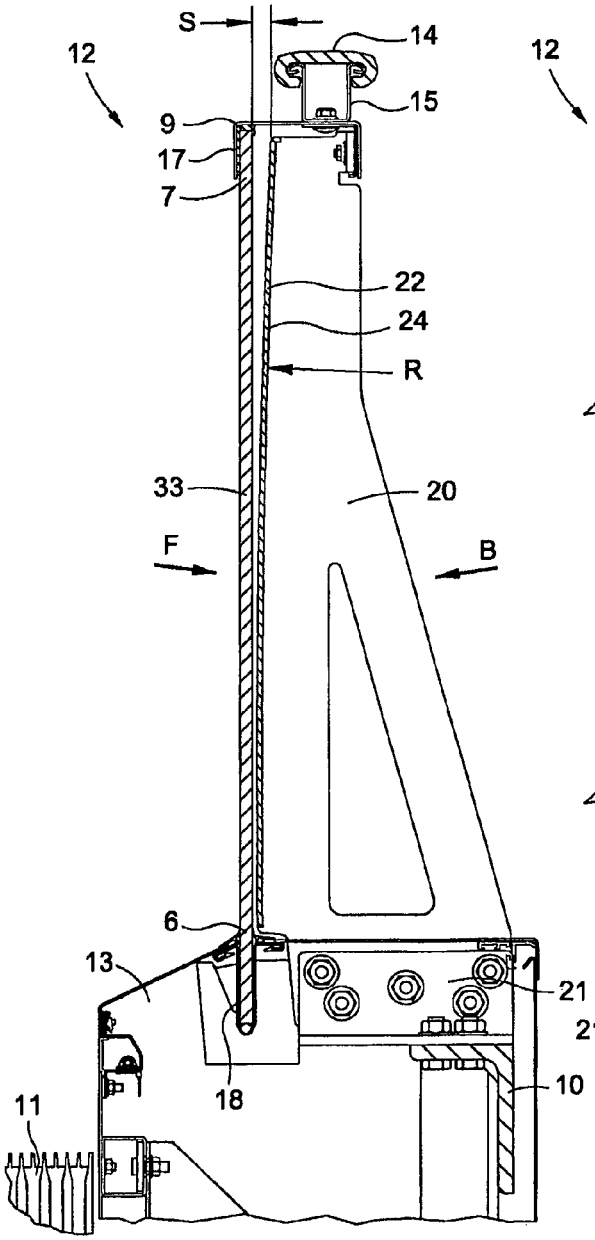
FIG. 3*b* a cross section through a balustrade in a further embodiment.

FIGS. 3*a*, 3*b*, and 3*c* each show a cross section through a balustrade 12 according to the invention in a different embodiment. In all three embodiments, a glass panel 33, as single-sheet safety glass or as multi-sheet laminated safety glass, is tightly fixed and anchored in a locationally fixed mounting 18 in a balustrade skirt 13. In all three embodiments, the balustrade skirt 13 is firmly joined to the supporting frame 10 of the escalator 1 (see FIG. 1). Arranged on the side of the glass panel 33 that faces away from the step-band 11 (see also FIG. 2) is a support 20, which, with a contact-edge 24, is aligned with the panel 33. The support 20 is aligned approximately perpendicular to the supporting frame 10 of the escalator. The support is also aligned perpendicular to the glass panel 33. By means of a plurality of bolts, the support 20 is fastened to the supporting frame 10 with fastening brackets 21, of which in each case only one is visible. However, other types of fastening are also conceivable, for example rivets, clinches, or welds. The support 20, with its contact-edge 24, is at least partly distanced from the glass panel 33. Since the glass panel 33 possesses a certain elasticity in the lateral direction, in other words towards the support 20, the distance between support 20 and glass panel 33 is the deformation play s, which designates the maximum displaceability of the glass panel 33. A load or lateral force F that arises acts as stated from the step-band 11 to the glass panel 33.

The support 20 of FIG. 3*a* has a straight contact-edge 24, which means that the deformation play s is present over the entire height of the support. At its upper end 7, the glass panel 33 is borne in an elastic flexible bearing 8, which prevents a lateral displacement of the upper edge 9 of the glass panel 33 but allows a tilting movement of the upper end 7 of the glass panel 33. This means that neither at its lower end 6, where it is fixed in the locationally fixed mounting 18, nor at its upper end 7, can it be laterally displaced. The only displacement that is possible is the deformation play s in the central area of the glass panel 33. The flexible bearing 8 is arranged in a longitudinal section 17, which is fastened onto the support 20 and at the same time accommodates the handrail guide 15 with the handrail 14.

The support 20 of FIG. 3*b* has a convexly curved contact-edge 24. At its lower end 6, the glass panel 33 rests against the contact-edge 24 of the support 20. The contact-edge 24 is provided with a damping layer 22 so that an impact of the glass panel 33 against the contact-edge 24 is damped and does not cause damage to the glass panel 33. Through the convex curvature, which corresponds to the minimum permissible bending radius R of the glass panel 33, the distance of the contact-edge 24 from the glass panel 33 increases with increasing height of the glass panel. The glass panel 33 therefore has in the area of its lower end 6 a small deformation play s for lateral displacement and, at its upper end 7, a larger deformation play s. Furthermore, the upper edge 9 of the glass panel 33 is borne laterally movable in a longitudinal section 17. The longitudinal section 17, in turn, accommodates the handrail guide 15 with the handrail 14 and is fastened to the support 20. The bending radius R and radius of curvature is adapted to the material that is used for the glass panel and has a dimension of 24 m to 120 m.

The support 20 of FIG. 3*c* has a concavely curved contact-edge 24. In the area of its lower end and its upper end 6, 7, the glass panel 33 rests against the contact-edge 24. Only in a central area of the glass panel 33 does there exist a deformation play s between the contact-edge 24 and the glass panel 33. The upper edge 9 of the glass panel 33 is accommodated in an elastic flexible bearing 8, so that the glass panel 33 with its upper edge 9 is held, but borne in tiltable or swivelable manner. The flexible bearing 8 is arranged in a longitudinal section 17, which, in turn, accommodates the handrail guide 15 and the handrail 14 and is fastened to the support 20. The bending radius R is, in turn, adapted to the material that is used for the glass panel and is dimensioned at 32 m to 110 m. In the areas of the lower and upper ends 6, 7, between the contact-edge 24 and the glass panel 33, damping layers 22 can also be arranged. Self-evidently, these can also extend over the entire length of the contact-edge 24.

Figure 4:
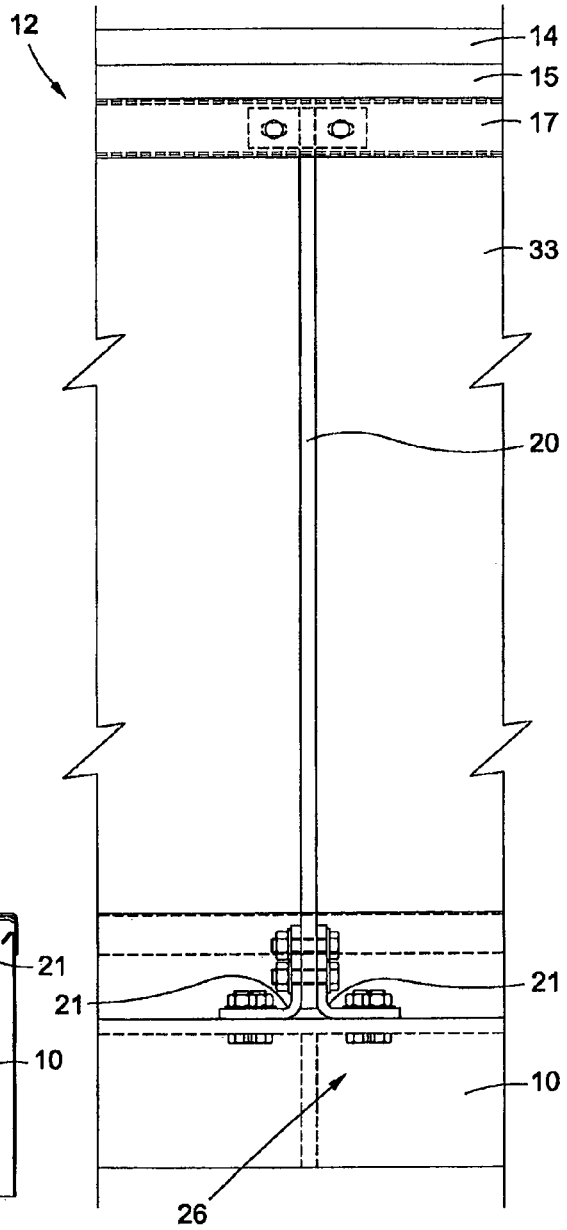
FIG. 4 a cutout of a view onto the balustrade according to FIG. 3*b* viewed in direction B.

Shown in FIG. 4 is a cutout of a view onto the balustrade 12 according to FIG. 3*b* viewed in the direction B. Clearly recognizable are the glass panel 33 and the support 20. At its upper end 33, the glass panel 33 is accommodated by the longitudinal section 17, which, by means of a bolted connection, is fastened to the support 20. Arranged on the longitudinal section 17 are the handrail guide 15 and the handrail 14. With the aid of two fastening brackets 21, the support 20 is bolted to an accommodating point 26 of the supporting frame 10.

Although the invention is described in detail with reference to an escalator, it is self-evident that a balustrade of a moving walk can also be embodied in the same way.

Further, individual characteristics of the exemplary embodiments can be combined with each other in that, for example, the support that is shown in FIG. 3*a* can also have a damping layer. Furthermore, on an escalator or on a moving walk, supports with differently embodied contact-edges, or different rigidities, can be used depending on the section of the balustrade. Preferably, however, all supports of an escalator or a moving walk are embodied identically, so that the manufacturing costs, storage costs, and installation costs can be kept as low as possible.

The invention claimed is:

1. Transparent balustrade (12) of an escalator (1) or of a moving walk, comprising a balustrade skirt (13), at least one glass panel (31, 32, 33), and a handrail guide (15) with a handrail (14), wherein the at-least one glass panel (31, 32, 33) has an upper edge (9) and a lower end (6) and, at its lower end (6), is gripped in a mounting (18) in the balustrade skirt (13) in a locationally fixed manner, wherein the transparent balustrade (12) contains at least one support (20), which, in a locationally fixed manner, is joined to at least one of the balustrade skirt (13) a supporting frame (10) of the escalator (1) or moving walk, the glass panel (31, 32, 33) having elastic properties for impact energy absorption whereby a limited elastic displacement of a part of the at least one glass panel (31, 32, 33) through deformation of the at least one glass panel (31, 32, 33) perpendicular to its planar extent, and therefore in a lateral direction, is permitted;

a permitted lateral displacement takes place within a permissible deformation play range dependent upon the material properties of the at least one glass panel; and the permitted lateral displacement within the permissible deformation play range is limited by the support (20); wherein the at least one glass panel has free play between its upper edge and lower end and the support (20) has a contact-edge (24) that faces the at least one glass panel (31, 32, 33) and spaced therefrom and, in an unloaded state, the permitted lateral displacement is present between the contact-edge (24) of the support (20) and the at least one glass panel (31, 32, 33).

2. Balustrade (12) according to claim 1, wherein within the permissible deformation play range, the upper edge (9) is freely displaceable.

3. Balustrade (12) according to claim 1, wherein in at least a partial area, the contact-edge (24) of the support (20) has a damping layer (22).

4. Balustrade (12) according to claim 3, wherein the contact-edge (24) defines a minimum bending radius (R) for the at least one glass panel (31, 32, 33).

5. Balustrade (12) according to claim 1, wherein at a greatest displacement point, the permissible deformation play range is between 2 mm and 10 mm.

6. Balustrade (12) according to claim 5, wherein, at the greatest displacement point, the permissible deformation play range is between 4 mm and 8 mm.

7. Balustrade (12) according to claim 5, wherein, at the greatest displacement point, the permissible deformation play range is between 5 mm and 6 mm.

8. Balustrade (12) according to claim 1, wherein the at least one glass panel (31, 32, 33) is a single-sheet safety-glass sheet.

9. Balustrade (12) according to claim 1, wherein the at least one glass panel (31, 32, 33) is a two-sheet safety-glass sheet.

10. Balustrade (12) according to claim 1, wherein the at least one glass panel (31, 32, 33) is borne with its upper edge (9) in a longitudinal section (17).

11. Balustrade (12) according to claim 10, wherein the longitudinal section (17) is connected to the support (20).

12. Balustrade (12) according to claim 10, wherein the upper edge of the glass panel (31, 32, 33) is accommodated in an elastic flexible bearing (8) of the longitudinal section (17).

13. Balustrade (12) according to claim 1, wherein the handrail guide (15) is fastened to the support (20).

14. Escalator (1) or moving walk with a balustrade (12) according to claim 1.

15. Escalator (1) or moving walk according to claim 14, wherein a supporting frame (10) of the escalator (1), or moving walk, has a plurality of acceptance points (26) for fastening supports (20) of the balustrade (12) arranged at regular intervals.

16. Modernization process for an existing escalator (1) or moving walk, comprising the steps of removing at least one of the present balustrades of the-existing moving walk or escalator, and providing the existing escalator (1) or moving walk with at least one transparent balustrade (12), according to claim 1.

* * * * *